United States Patent [19]

Gorzegno

[11] Patent Number: 4,473,035

[45] Date of Patent: Sep. 25, 1984

[54] SPLITTER-BIFURCATE ARRANGEMENT FOR A VAPOR GENERATING SYSTEM UTILIZING ANGULARLY ARRANGED FURNACE BOUNDARY WALL FLUID FLOW TUBES

[75] Inventor: Walter P. Gorzegno, Morristown, N.J.

[73] Assignee: Foster Wheeler Energy Corporation, Livingston, N.J.

[21] Appl. No.: 409,384

[22] Filed: Aug. 18, 1982

[51] Int. Cl.[3] ..... F22B 29/02; F22D 7/00

[52] U.S. Cl. ..... 122/235 A; 122/235 C; 122/406 S; 285/155

[58] Field of Search ..... 138/38, 39; 285/132, 285/137 R, 155; 122/336, 406 S, 511, DIG. 4; 137/561 A, 875

[56] References Cited

U.S. PATENT DOCUMENTS

| | | | |
|---|---|---|---|
| 1,378,054 | 5/1921 | Pratt | 285/155 |
| 3,376,897 | 4/1968 | Dolder et al. | 285/155 X |
| 4,178,881 | 12/1979 | Pratt et al. | 122/235 C X |
| 4,252,149 | 2/1981 | Dollison | 137/875 X |

FOREIGN PATENT DOCUMENTS

| | | | |
|---|---|---|---|
| 592654 | 9/1947 | United Kingdom | 138/39 |

*Primary Examiner*—Henry C. Yuen

*Attorney, Agent, or Firm*—Marvin A. Naigur; John E. Wilson; Warren B. Kice

[57] ABSTRACT

A vapor generating system including an upright furnace section formed by a plurality of tubes, a portion of which extends vertically and a portion of which extends at an angle with respect to a horizontal plane for passing fluid through the length of the furnace section to convert a portion of the fluid to vapor or to heat the fluid. Each angularly extending tube portion bifurcates into two vertical tube portions and a bifurcate fixture is provided at the junction between the respective tube portions. Each of the bifurcates connecting the angularly extending tube portions to their respective vertical tube portions in the upper portion of the furnace section includes a splitter plate to distribute the fluid in the angular tube portion equally to two vertical tube portions.

6 Claims, 7 Drawing Figures

FIG. 3.
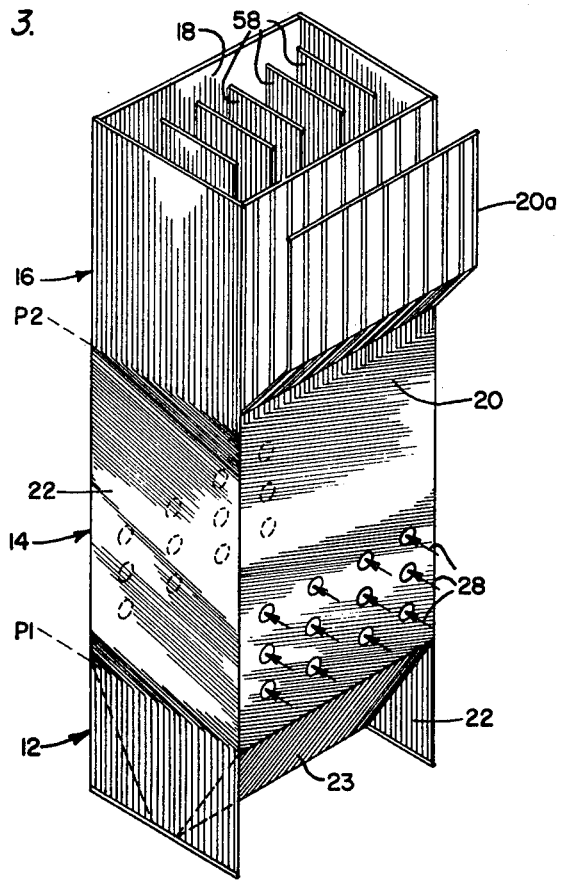
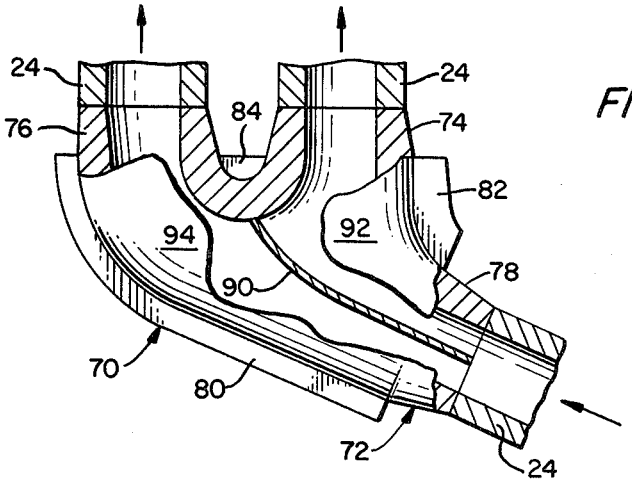
FIG. 7.

SPLITTER-BIFURCATE ARRANGEMENT FOR A VAPOR GENERATING SYSTEM UTILIZING ANGULARLY ARRANGED FURNACE BOUNDARY WALL FLUID FLOW TUBES

BACKGROUND OF THE INVENTION

This invention relates to a vapor generating system and, more particularly, to a sub-critical or super-critical once-through vapor generating system for converting water to vapor.

In general, a once-through vapor generator operates to circulate a pressurized fluid, usually water, through a vapor generating section and a superheating section to convert the water to vapor. In these arrangements, the water entering the unit passes once through the circuitry and discharges from the superheating section outlet of the unit as superheated vapor for use in driving a turbine, or the like.

These arrangements provide several improvements over conventional drum-type boilers, and although some problems arose in connection with early versions of the once-through generators, such as excessive startup thermal losses, mismatching of steam temperature, the requirement for sophisticated controls and additional valving during startup, these problems have been virtually eliminated in later generating systems.

For example, the system disclosed in U.S. Pat. No. 4,099,384 and assigned to the assignee of the present application, includes a plurality of separators disposed in the main flow line between the vapor generating section and the superheating section and adapted to receive fluid flow from the vapor generating section during startup and full load operation of the system. This arrangement enables a quick and efficient startup to be achieved with a minimum of control functions, and with minimal need for costly valves. Also, the turbines can be smoothly loaded at optimum pressures and temperatures that can be constantly and gradually increased without the need of boiler division valves or external bypass circuitry for steam dumping. Also, according to this system, operation can be continuous at very low load with a minimum of heat loss to the condenser.

In the latter arrangement, the walls of the furnace section of the generator are formed by a plurality of vertically extending tubes having fins extending outwardly from diametrically opposed portions thereof, with the fins of adjacent tubes being connected together to form a gas-tight structure. During startup, the furnace operates at constant pressure and supercritical water is passed through the furnace boundary walls in multiple passes to gradually increase its temperature. This requires the use of headers between the multiple passes to mix out heat unbalances caused by portions of the vertically extending tubes being closer to the burners than others or by the tubes receiving uneven absorption because of local slag coverage, burners being out of service, and other causes. The use of these intermediate headers, in addition to being expensive, makes it undesirable to operate the furnace at variable pressure because of probability of separation of the vapor and liquid within the header and uneven distribution to the downstream circuit. Therefore, this type of arrangement requires a pressure reducing station interposed between the furnace outlet and the separators to reduce the pressure to predetermined values and, in addition, requires a relatively large number of downcomers to connect the various passes formed by the furnace boundary wall circuitry.

U.S. Pat. No. 4,178,881, also assigned to the present assignee discloses a vapor generator which incorporates the features of the system discussed above and yet eliminates the need for intermediate headers, additional downcomers, and a pressure reducing station. Toward this end, the boundary walls of the furnace section of the latter vapor generator are formed by a plurality of interconnected tubes, a portion of which extends at an acute angle with respect to a horizontal plane. In this arrangement, the boundary walls defining the upper and lower portions of the furnace section of the vapor generator are formed by vertical tube portions and the intermediate portion of the furnace section are formed by angular tube portions. A bifurcated fitting is provided to connect one angular tube portion to two vertical tube portions so that twice as many tubes are used in the upper and lower portions of the furnace section than in the intermediate portion.

As a result of this arrangement the fluid is passed through the boundary wall circuitry of the furnace section in one single complete pass without the need for mix, or intermediate headers or the like.

SUMMARY OF THE INVENTION

It is an object of the present invention to provide a vapor generator which incorporates all of the above-mentioned advantages of the angularly extending tube arrangement discussed above and, in addition, insures that fluid of equal enthalpy and fluid quality passes into the vertical tube portions of the upper furnace section.

It is another object of the present invention to provide a vapor generator of the above type in which a bifurcated fitting is provided at the junction between an angular tube portion and its two corresponding vertical tube portions and includes a splitter plate to provide an equal flow of fluid from the angular tube portion to two vertical tube portions.

BRIEF DESCRIPTION OF THE DRAWINGS

The above brief description, as well as further objects, features and advantages, of the present invention will be more fully appreciated by reference to the following detailed description of a presently preferred but nonetheless illustrative embodiment in accordance with the present invention, when taken in conjunction with the accompanying drawings wherein:

FIG. 3 is a partial perspective view of a portion of the vapor generator of FIG. 1;

FIG. 7 is an enlarged, partial sectional-partial elevational view of a bifurcate disposed in the upper portion of the boundary wall of FIG. 4.

DESCRIPTION OF THE PREFERRED EMBODIMENTS

Figure 1:
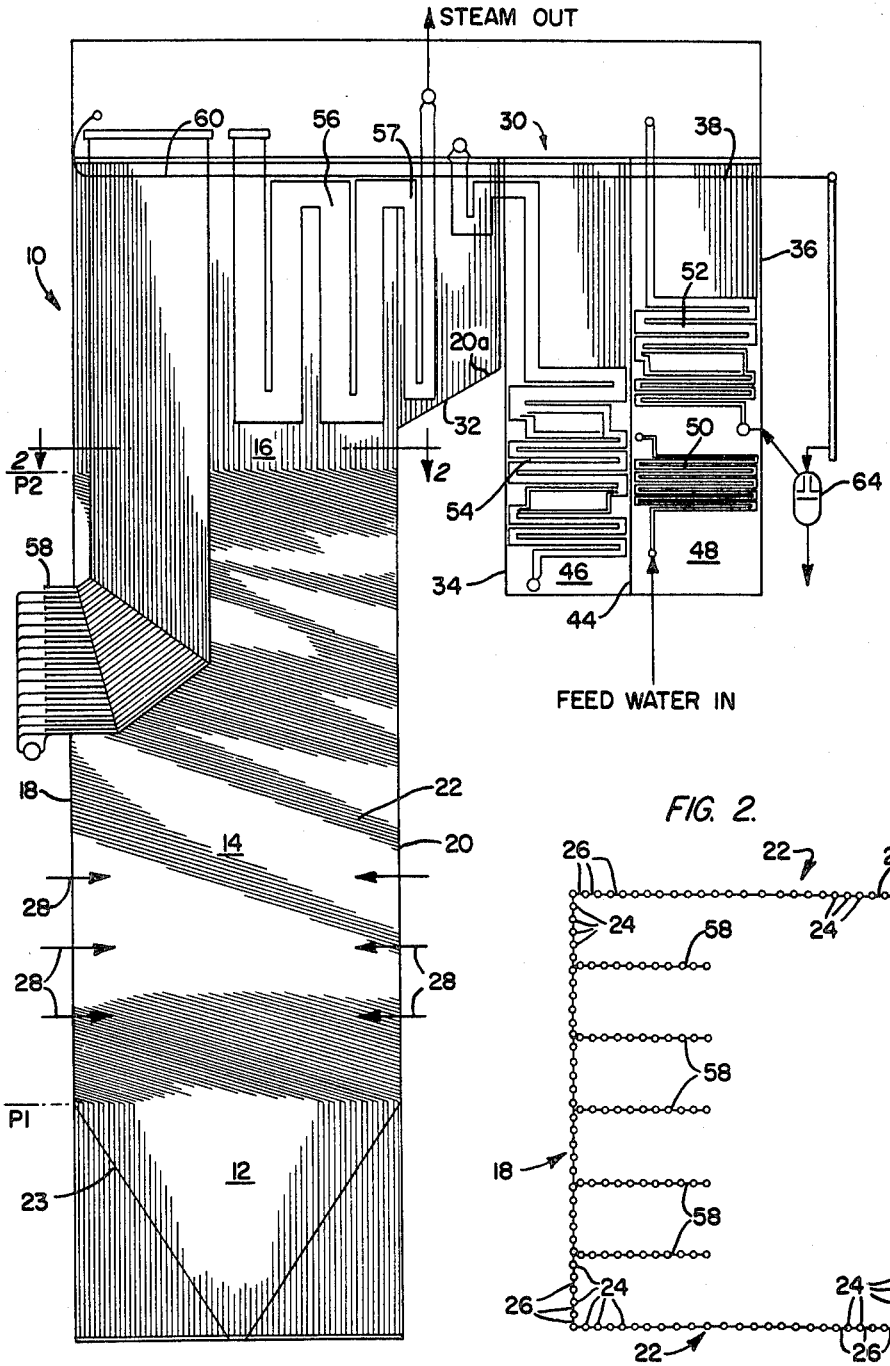
FIG. 1 is a schematic sectional view of the vapor generator of the present invention.

Referring specifically to FIG. 1 of the drawings, the reference numeral 10 refers in general to a vapor generator utilized in the system of the present invention and including a lower furnace section 12, an intermediate furnace section 14, and an upper furnace section 16. The boundary walls defining the furnace sections 12, 14 and 16 include a front wall 18, a rear wall 20 and two sidewalls extending between the front and rear wall, with one of said sidewalls being referred to by the reference numeral 22. The lower portions of the front wall 18 and the rear wall 20 are sloped inwardly to form a hopper section 23 at the lower furnace section 12 for the accumulation of ash, and the like, in a conventional manner.

Figure 2:
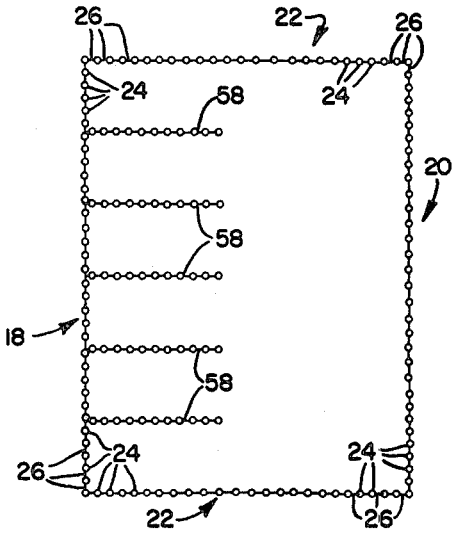
FIG. 2 is a sectional view taken along the line 2—2 of FIG. 1.

As shown in FIG. 2, each of the walls 18, 20 and 22 are formed of a plurality of tubes 24 having continuous fins 26 extending outwardly from diametrically opposed portions thereof, with the fins of adjacent tubes being connected together to form a gas-tight structure. Although not shown in the drawings, it is understood that the outer portions of the walls 18, 20 and 22 are insulated and cased in a conventional manner.

Referring specifically to FIGS. 1 and 3, the tubes 24 in the walls 18, 20 and 22 of the lower furnace section 12 extend vertically up to a horizontal plane P1 located at the upper portion of the hopper section 23. The tubes 24 forming the walls 18, 20 and 22 in the intermediate section 14 extend from the plane P1 to a plane P2 disposed in the upper portion of the vapor generator 10, with these tubes extending at an acute angle with respect to the planes P1 and P2. The tubes 24 forming the walls 18, 20 and 22 of the upper furnace section 16 extend vertically from the plane P2 to the top of the latter section. The tubes 24 in the intermediate section 14 extend from plane P1 and wrap around for the complete perimeter of the furnace at least one time to form the walls 18, 20 and 22 before they terminate at plane P2. The tubes 24 in the intermediate section 14 have a plurality of the fins 26 which are arranged and which function in an identical manner to the fins of the tubes in the lower furnace section 12 and in the upper furnace section 14.

As will be described in detail later, the upper end of each angularly extending tube 24 in the intermediate furnace section 14 registers with two vertically extending tubes 24 in the upper furnace section 16. In a similar manner, the lower end of each tube 24 in the intermediate section 14 registers with two vertically extending tubes 24 in the sidewalls 22 of the hopper section 12, with two inwardly sloped tubes of the rear wall 20 which together form the hopper section 23.

As also shown in FIGS. 1 and 3, the upper portion of the rear wall 20 in the upper section 16 has a branch wall **20*a* which is formed by bending a selected number of tubes 24 from the rear wall 20 outwardly in a manner to define spaces between the remaining tubes 24 in the wall 20 and between the tubes forming the branch wall 20*a* to permit combustion gases to exit from the upper furnace section 16**, as will be described later.

A plurality of burners 28 are disposed in the front and rear walls 18 and 20 in the intermediate furnace section 14, with the burners being arranged in this example in three vertical rows of four burners per row. The burners 28 are shown schematically since they can be of a conventional design.

A vestibule-convection area, shown in general by the reference numeral 30, is provided in gas flow communication with the upper furnace section 16 and includes a vestibule floor 32 defined in part by portions of the tubes 24 forming the branch wall **20*a*. The convection of the area 30 includes a front wall 34, a rear wall 36 and two sidewalls 38, with one of the latter being shown in FIG. 1. It is understood that the vestibule floor 32 is rendered gas-tight and that the front wall 34 and rear wall 36 are formed of a plurality of vertically extending, interconnected tubes 24 in a similar manner to that of the upper furnace section 16**.

A partition wall 44, also formed by a plurality of interconnected tubes 24, is provided in the vestibule-convection area 30 to divide the latter into a front gas pass 46 and a rear gas pass 48. An economizer 50 is disposed in the lower portion of the rear gas pass 48, a primary superheater 52 is disposed immediately above the economizer, and a bank of reheater tubes 54 is provided in the front gas pass 46.

A platen superheater 56 is provided in the upper furnace section 16 and a finishing superheater 57 is provided in the vestibule portion of the heat recovery area 30 in direct fluid communication with the platen superheater 56.

A plurality of division walls 58 are provided with each having a portion disposed adjacent the front wall 18. The division walls 58 penetrate a portion of the tubes 24 of the latter wall in the intermediate furnace section 14, and extend upwardly within the upper furnace section 16 as shown in FIGS. 1 and 3. These walls 58 may also be arranged as non-drainable pendant platens in the upper furnace section 16.

The upper end portions of the walls 18, 20 and 22, the branch wall **20*a*, and the division walls 58, as well as the partition wall 44, sidewalls 38, front wall 34, and rear wall 36 of the vestibule-convection area 30, all terminate in substantially the same general area in the upper portion of the vapor generating section 10**.

A roof 60 is disposed in the upper portion of the section 10 and consists of a plurality of tubes 24 having fins 26 connected in the manner described above, but extending horizontally from the front wall 18 of the furnace section to the rear wall 36 of the vestibule-convection area 30.

It can be appreciated from the foregoing that combustion gases from the burners 28 in the intermediate furnace section 14 passes upwardly to the upper furnace section 16 and through the vestibule-convection area 30 before exiting from the front gas pass 46 and the rear gas pass 48. As a result, the hot gases pass over the platen superheater 56, the finishing superheater 57 and the primary superheater 52, as well as the reheater tubes 54 and the economizer 50, to add heat to the fluid flowing through these circuits.

Although not shown in the drawings for clarity of presentation, it is understood that suitable inlet and outlet headers, downcomers and conduits, are provided to place the tubes 24 of each of the aforementioned walls and heat exchangers as well as the roof 60 in fluid communication to establish a flow circuit that will be described in detail later.

A plurality of separators 64, disposed in a parallel relationship adjacent the rear wall 36 of the vestibule-convection area 30, are installed directly in the main flow circuit between the roof 60 and the primary superheater 52. The separators 64 may be identical to those described in the above-mentioned patent and operate to separate the two-phase fluid exiting from the roof 60 into a liquid and vapor. The vapor from the separators 64 is passed directly to the primary superheater 52 and the liquid is passed to a drain manifold and heat recovery circuitry for further treatment as also disclosed in the above-mentioned patent.

Figure 4:
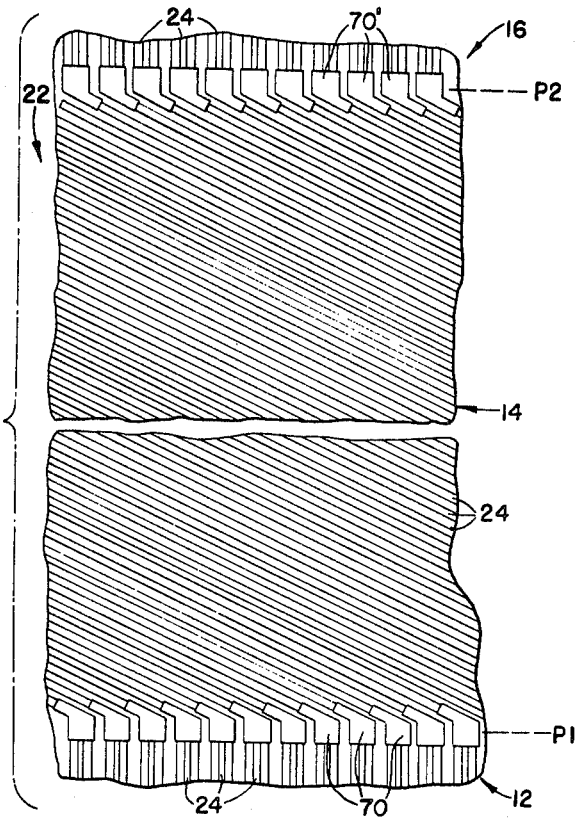
FIG. 4 is an enlarged, partial, elevational view of a boundary wall of the vapor generator of FIG. 1.

Referring to FIG. 4, which depicts a portion of a sidewall 22 of the vapor generator of the present invention, the reference numeral 70 refers in general to a plurality of bifurcates which extend along each of the walls 18, 20 and 22 in the plane P1 where each bifurcate connects one of the angularly extending tubes 24 in the intermediate furnace section 14 to two vertically extending tubes in the lower furnace section 12. Although the above arrangement is shown in FIG. 4 only in connection with one sidewall 22, it is understood that it is identical with respect to the front wall 18, the rear wall 20, and the other sidewall 22, with the exception, of course, that the tubes 24 in the walls 18 and 20 of the lower furnace section 12 slope inwardly to form the hopper section 23.

Figure 5:
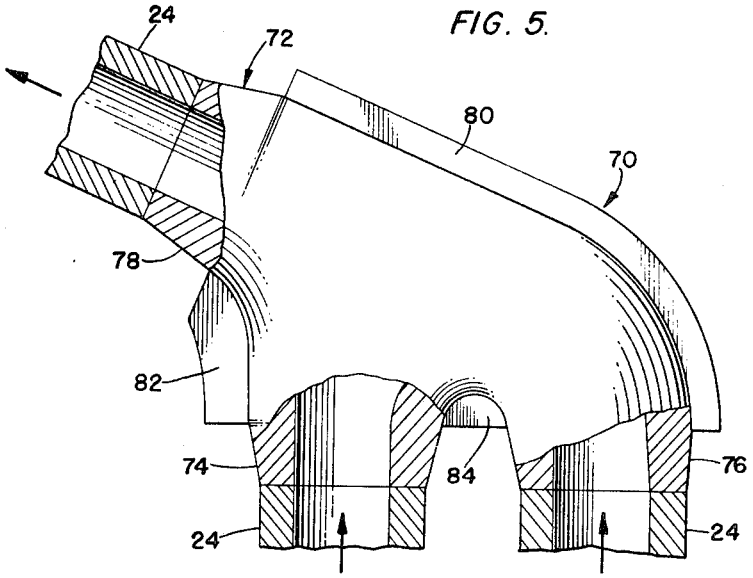
FIG. 5 is an enlarged, partial sectional-partial elevational view of a bifurcate disposed in the lower portion of the boundary wall of FIG. 4.

The details of a birfurcate 70 are shown in FIG. 5. In particular, each bifurcate 70 is in the form of a hollow body 72 shaped in a manner to define two boss sections 74 and 76 extending from one surface of the body in a spaced parallel relationship, and a single boss section 78 extending from another surface of the body 72 and at an angle with respect to the axis of the boss section 74 and 76. Each of the boss sections 74, 76 and 78 is adapted to be secured to an end of a tube 24 in a conventional manner, such as by welding, to register the tubes and permit fluid flow between the tubes through the hollow body 72. The sizes of the boss sections 74, 76 and 78 depend, of course, on the size of the tubes that they are to accommodate and, for the purposes of example, the diameter of the tubes 24 in the upper furnace section 16 and the lower furnace section 12 can be $1\frac{1}{8}$ inch while the diameter of the tubes in the intermediate furnace section 14 can be $1\frac{3}{8}$ inch. Also, the angle between the axis of the boss section 78 and the axes of the boss sections 74 and 76, and therefore the angle that the tubes 24 in the intermediate furnace section extend with respect to the planes P1 and P2, varies to suit furnace geometry and can be between 10° and 35°, and for the specific embodiment described, is 22°.

Figure 6:
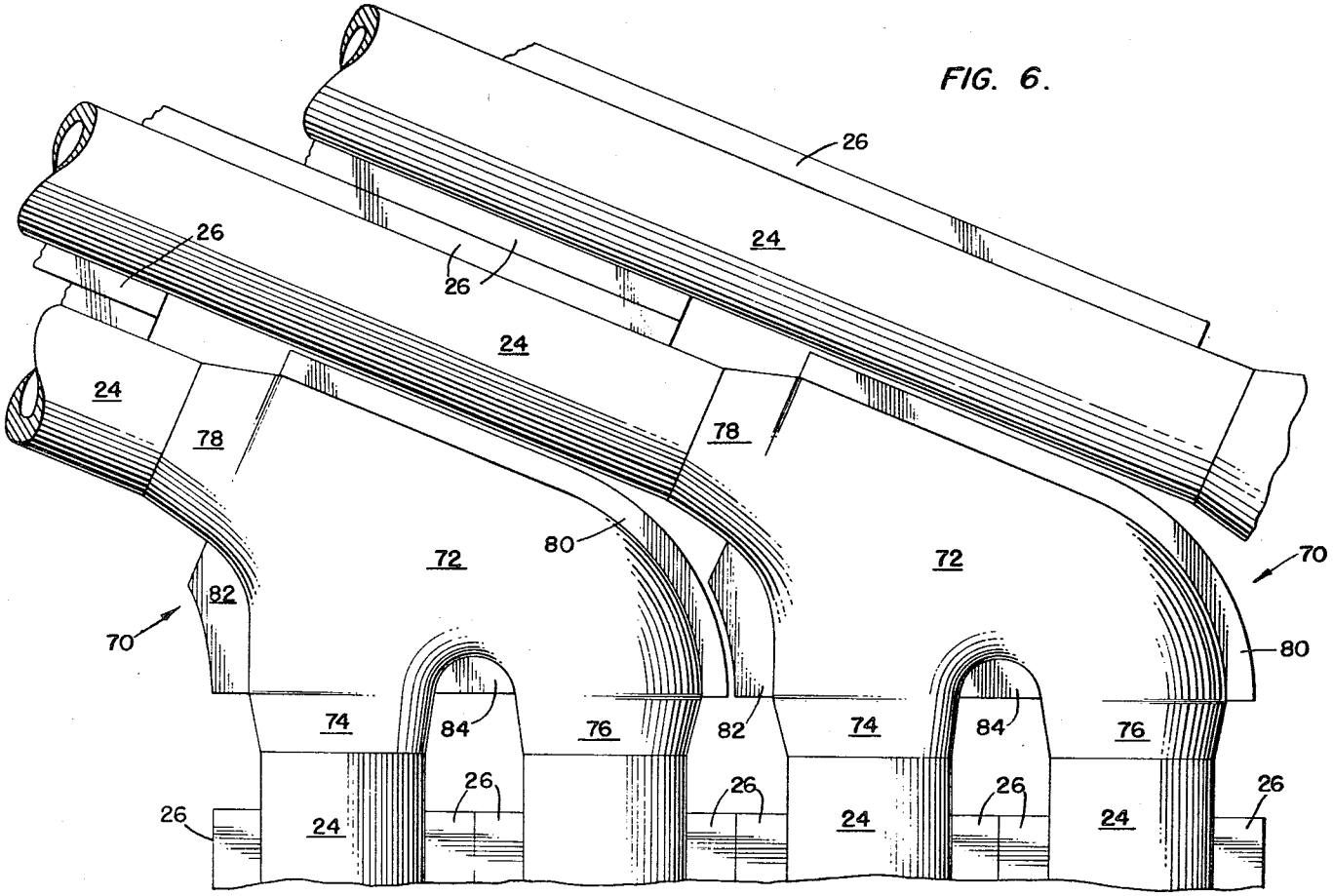
FIG. 6 is an enlarged partial, elevational view of a lower portion of the boundary wall of FIG. 4, and depicting two of the bifurcates of FIG. 5.

An elongated fin 80 is provided along one side of the bifurcate 70, a relatively short fin 82 is provided on the opposite side thereof, and a fin 84 is provided between the boss sections 74 and 76 for facilitating an air-tight connection between the adjacent bifurcates. This is shown in greater detail in FIG. 6 which depicts two adjacent bifurcates 70 and the connections with their corresponding tubes 24. Since the fins 80, 82 and 84 can be cast integral with the bifurcates 70, it is apparent from FIG. 6 that the amount of hand finning and welding is reduced at the time of fabrication to fill in the openings between adjacent bifurcates 70 and tubes 24 to form the boundary walls of the furnace sections.

Referring again to FIG. 4, the reference numeral 70' refers to a plurality of bifurcates which extend along each of the walls 18, 20 and 22 in the plane P2 where each bifurcate connects one of the angularly extending tubes 24 in the intermediate furnace section 14 to two vertically extending tubes 24 in the upper furnace section. The bifurcates 70' are identical to the bifurcates 70, with the exceptions that the bifurcates 70' are in a reverse orientation compared to the bifurcates 70 and contain a splitter plate 90 as shown in FIG. 7. The plate 90 is located within the hollow body 72 and is oriented in a manner to bisect the interior of the body and thus form two flow chambers 92 and 94.

Thus, the fluid entering the body 72 from the outlet end of the angularly extending tube 24 is split by the plate 90 into two substantially equal flow streams, which are directed to their respective vertical tubes 24 via the chamber 92 and the chamber 94, respectively. Since the inner portions of the tubes 24 are directly exposed to heat from the interior portion of the upper furnace section 16 and their outer portions are exposed to the relative cool insulated and cased portion of the furnace, each splitter plate 90 splits the relative hot fluid into two portions which are respectively passed to the vertical tubes, and the relative cool fluid into two portions which are also respectively passed to the vertical tubes. This insures that the fluid passing into the vertical tubes 24 in the upper furnace section is of equal enthalpy and fluid quality, which is essential for an even heat distribution throughout the furnace.

In operation, feedwater from an external source is passed through the economizer tubes 50 to raise the temperature of the water before it is passed to inlet headers (not shown) provided at the lower portions of the furnace walls 18, 20 and 22. All of the water flows upwardly and simultaneously through the walls 18, 20 and 22 to raise the temperature of the water further to convert at least a portion of same to vapor, before it is collected in suitable headers located at the upper portion of the vapor generator 10. The fluid is then passed downwardly through a suitable downcomer, or the like and then upwardly through the division walls 58 to add additional heat to the fluid. The fluid is then directed through the walls 34, 36, 38 and 44 of vestibule-convection area 30 after which it is collected and passed through the roof 60. From the roof 60, the fluid is passed via suitable collection headers, or the like, to the separators 64 which separate the vapor portion of the fluid from the liquid portion thereof. The liquid portion is passed from the separators to a drain manifold and heat recovery circuitry (not shown) for further treatment, and the vapor portion of the fluid in the separators 64 is passed directly into the primary superheater 52. From the latter, the fluid is spray attemperated after which it is passed to the platen superheater 56 and the finishing superheater 57 before it is passed in a dry vapor state to a turbine or the like.

Several advantages result from the foregoing. For example, the use of the angularly extending tubes which wrap around to form the intermediate furnace section 14 enables the fluid to average out furnace heat unbalances and be passed through the boundary walls 18, 20 and 22 of the furnace section in one complete pass, thus eliminating the use of multiple passes and their associated intermediate headers and downcomers. Also, as a result of the angularly extending tubes, a relatively high mass flow rate and large tube size can be utilized over that possible with vertical tube arrangements. Further, the bifurcations eliminate the use of intermediate, or mix headers at the top of furnace section 14 and allow the use of an increased number of vertical tubes in the upper and lower sections of the generator when compared to those in the intermediate furnace section. The use of these vertical tubes in the lower furnace section 12 permits a smooth shape transition between sections 12 and 14. Also, the splitter plate 90 in each upper bifurcate 70' insures that the fluid passing into the vertical tubes in the upper furnace section 16 is of equal enthalpy and fluid quality.

It is understood that while the preferred embodiment described above includes a furnace having a substantially rectangular shaped cross-sectional area, other cross-sectional configurations, such as those having a circular or elliptical pattern, may be utilized as long as the angular tube arrangement is maintained. For example, the furnace may have a helical configuration in a pattern conforming to the cross-sectional shape of the furnace. (In this context, it should be noted that the type of boiler covered by the present invention in which the tubes are angularly arrange in the furnace boundary wall is commonly referred to by those skilled in the art as a "helical tube boiler", notwithstanding the fact that a true mathmatical helix is not generated in a boiler which has a substantially rectangular cross-sectional area.) It is also understood that the tubes may wrap around the furnace short of a complete revolution or for more than one complete revolution, depending on the overall physical dimensions of the furnace.

It is further understood that portions of the vapor generator have been omitted for the convenience of presentation. For example, support systems can be provided that extend around the boundary walls of the vapor generator and a windbox or the like may be provided around the burners 28 to supply air to same in a conventional manner. It is also understood that the upper end portions of the tubes 24 forming the upper furnace section 16 and vestibule-convection area 30 can be hung from a location above the vapor generating section 10 to accommodate top support and thermal expansion in a conventional manner.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention therein.

What is claimed is:

1. A vapor generator comprising an upright furnace section the boundary walls of which are formed by a plurality of tubes, means for passing fluid through said tubes to apply heat to said fluid, the inner portions of said tubes being directly exposed to heat from said furnace section and the outer portions of said tubes being exposed to the relative cool insulated portion of said furnace section so that each angular tube contains relative high enthalpy fluid and relative low enthalpy fluid, the portions of said tubes in the upper and lower portions of said furnace section extending substantially vertically, and the portions of said tubes intermediate said upper and lower portions extending at an acute angle with respect to a horizontal plane, a bifurcated fitting connecting each angular tube to two vertical tubes in said upper portion of said furnace section, and a splitter plate disposed in said fitting and forming an extension of the axis of said angular tube and extending at an angle to said vertical tubes and substantially perpendicular to the corresponding wall for splitting said relative high enthalpy fluid into two portions which are respectively passed to said vertical tubes and said relative low enthalpy fluid into two portions which are respectively passed to said vertical tubes, an additional group of bifurcated fittings connecting said angular tubes to said vertical tubes in said lower portion of said furnace section, said tubes and said bifurcated fittings having fins extending outwardly from diametrically opposed portions thereof, with the fins of adjacent tubes and adjacent fittings being welded together to form a gas-tight structure.

2. The vapor generator of claim 1 wherein all of said fluid is passed simultaneously through the tubes of all of said boundary walls.

3. The vapor generator of claim 1 wherein said furnace section has a rectangular horizontal cross-section.

4. The vapor generator of claim 1 wherein said angular tubes wrap around the furnace section for at least one revolution.

5. The vapor generator of claim 1 further comprising a superheating section, fluid separating means, and fluid flow circuitry connecting said fluid separating means in a series flow relation between said furnace section and said superheating section.

6. The vapor generator of claim 5 wherein said fluid separating means receives fluid from said furnace section during startup and full load operation of said system and separates said fluid into a liquid and a vapor, said fluid flow circuitry passing the vapor from said fluid separating means to said superheating section during startup and full load operation of said system.

* * * * *